United States Patent [19]

Miller et al.

[11] 4,220,893

[45] Sep. 2, 1980

[54] ELECTRICALLY RESISTIVE ARC SUPPRESSOR SHADOWING GETTER FLASH

[75] Inventors: Philip C. Miller, Morton Grove; Michael W. Retsky, Chicago, both of Ill.

[73] Assignee: Zenith Radio Corporation, Glenview, Ill.

[21] Appl. No.: 708,817

[22] Filed: Jul. 26, 1976

[51] Int. Cl.[2] ..... H01J 29/94; H01J 29/96

[52] U.S. Cl. ..... 313/450; 313/481

[58] Field of Search ..... 313/458, 477, 364, 481, 313/450, 181

[56] References Cited

U.S. PATENT DOCUMENTS

| | | | |
|---|---|---|---|
| 2,714,679 | 8/1955 | Van De Graaff et al. | 313/450 |
| 3,143,681 | 8/1964 | Schlesinger | 313/450 |
| 3,508,105 | 4/1970 | Pappadis | 313/178 |
| 3,564,327 | 2/1971 | Johnson | 313/18 1 |
| 3,802,757 | 4/1974 | Benda et al. | 313/481 X |
| 3,848,154 | 11/1974 | Bowes et al. | 313/481 |
| 3,882,348 | 5/1975 | Paridaens | 313/450 |
| 3,906,281 | 9/1975 | Nakamura et al. | 313/481 |
| 3,906,282 | 9/1975 | Krackhardt et al. | 313/481 |
| 3,909,655 | 9/1975 | Grimmett et al. | 313/450 |
| 3,939,376 | 2/1976 | Reash | 313/481 X |
| 3,961,221 | 6/1976 | Benda et al. | 313/481 |

FOREIGN PATENT DOCUMENTS

| | | | |
|---|---|---|---|
| 1448223 | 9/1976 | United Kingdom | 313/450 |

*Primary Examiner*—Robert Segal

*Attorney, Agent, or Firm*—Ralph E. Clarke, Jr.; John H. Coult

[57] ABSTRACT

This disclosure depicts an arc-suppression means for use in cathode ray tubes having an electron gun and ancillary electrical circuits susceptible to damaging electrical arcing currents, and wherein getter means are used to capture residual gases in the evacuated envelope of the tube. The arc-suppression means is electrically resistive and is connected in an electrical path between the gun and a high voltage source, and its surface is physically exposed to a deposit of getter material when the getter is flashed. The arc-suppression means includes shadowing means for shadowing at least portions of the exposed surface from a deposit of the getter material to prevent the creation of an electrically conductive shorting path capable of permitting an arc to bypass or substantially nullify the arc-suppression means.

17 Claims, 9 Drawing Figures

ELECTRICALLY RESISTIVE ARC SUPPRESSOR SHADOWING GETTER FLASH

CROSS REFERENCE TO RELATED PATENT APPLICATIONS

This application discloses apparatus described and claimed in copending applications Ser. No. 642,049, filed Dec. 18, 1975, now U.S. Pat. No. 4,032,811, Ser. No. 666,858, filed Mar. 15, 1976, now U.S. Pat. No. 4,058,753 and Ser. No. 494,123, filed Aug. 2, 1974, now U.S. Pat. No. 3,995,194 all assigned to the assignee of the present invention.

BACKGROUND OF THE INVENTION

This invention concerns an effective and practical means for suppressing electrical arcing currents in television cathode ray tube electron guns.

The damage caused by such arcing can take many forms. For example, components of the power supply stage that provide operating voltages for the cathode ray tube and the electron gun can be damaged severely. Other external circuitry such as the video drivers may also be damaged, especially if the circuits comprise transistors and integrated circuits. Also, as the discharge takes place between gun electrodes, the gun itself can be rendered inoperative. Even if gun damage is not permanent, the "sputtering" of materials of the electrodes which the arc has bridged can result in the subliming of the materials, which results in the coating of nearby insulative parts with an electrically conductive film that may cause further and more destructive arcing.

The environment in which an electron gun must operate within the cathode ray tube envelope is particularly conducive to arcing. Operating voltages are commonly very high—of the order of twenty-five to thirty kilovolts in present-day, high-brightness tubes. Also, electron-optical design constraints dictate that spacings between high-potential electrodes be extremely small, typically in the range of eight to forty mils. Further, the use of very narrow-necked tubes (some of which are less than an inch in inside diameter) for reduced beam deflection power has made it necessary to group the gun components in very close adjacency; i.e., the electrodes close to the glass mounting pillars (or "beads"), the electrodes close to the tube neck, the cathode close to the base, etc. Another factor conducive to arcing is the electron abundance in the environment within the tube: some electrons escape the narrow beam path established by the gun and build up electrostatic charges on the tube neck, thereby establishing potential arc paths. Also, high velocity electrons may emanate from the cathode to build up such charges.

The ability of an arc to bridge electrode gaps, and to destroy components is shown by the energy potential inherent in such a discharge. In an electron gun operating with an ultor voltage of 30 kilovolts, for example, the intensity of an arc of one microsecond duration can be of the order of 30 amperes, and the momentary peak current can be one hundred times that value.

The problems resulting from such arcing are well known in the art, and effective and practical solutions have been continually sought. A common prior art solution is to introduce an arc-suppressing impedance, usually some form of resistance, into the circuit that supplies the electron gun and cathode ray tube with high voltage. The method is shown schematically by FIG. 1, wherein a high voltage supply 1 provides high operating voltages (typically about thirty kilovolts) to an electron gun 2 through electrical leads 3 and 4. A conductive coating 5, deposited on the glass inner surface of the cathode ray tube funnel, is separated by dielectric 6 (the cathode ray tube glass) from a similar conductive coating 7, on the tube outer surface to form a capacitor. This capacitor serves as a component of the filter circuit of the high voltage power supply and acts to smooth out high voltage peaks.

In the prior art, arc-suppressing impedance 8 is typically introduced into the circuit to suppress any arcing that may develop. If the arc between electron gun components is not completely suppressed by impedance 8, the impedance is intended to at least reduce the energy of the discharge to a level of lesser destructiveness.

In another prior art embodiment, an arc-suppressing circuit may be located external to the cathode ray tube envelope and made a part of external circuitry, as shown schematically by 9. This expedient, however, is costly, and the remedy too remote from the actual site of the malfunction to be effective in dealing with an arc internal to the envelope. As a result, arc-suppression has been sought through means located within the tube envelope. Such protective means have included resistive coatings applied to the inner wall of the cathode ray tube neck, resistive elements incorporated into the snubber springs, or resistors incorporated into the convergence cup. These and similar structures have been described variously in representative U.S. Pat. Nos. 3,295,008; 2,829,292; 3,882,348; 3,909,655; and 3,355,617.

Prior art structures have met with varied success when faced with the severe environment within the cathode ray tube envelope. Some forms of resistive elements have proved to be inadequate electrically to accomplish the primary purpose of arc suppression. Other remedies are unnecessarily costly and complex and require manufacturing schemes of doubtful practicality.

Another factor that has exacerbated the problem (and this also relates to the aforesaid severe environment), is the fact that the getter is commonly flashed near the arc-suppression means. Resistive devices and other components enclosed in the evacuated envelope of a cathode ray tube can be made inoperative by the conductive fall-out produced by the flashing of the getter. The use of the getter is old in electron tube art; its simple function is to absorb residual gases that remain in the envelope following the vacuum pump air evacuation process. The getter structure commonly comprises a small "pan" containing alloys, primarily barium. This pan is positioned close to the inner wall of the tube envelope and is heated to a high temperature, nominally 900° C., by an induction coil located outside the envelope. This heating causes the getter to "flash," vaporizing the alloy and causing the capture of residual gases to make a better vacuum within the envelope. The getter fall-out mainly comprises a metallic residue deposited on funnel walls and on components adjacent to the area of the flash. Such deposits can be electrically conductive, and act as electrical shunts. For example, an exposed resistive surface used for arc-suppression could be effectively bypassed and short-circuited by deposits thereon of conductive material produced by the getter flash. It is the problem to which this invention is primarily addressed.

OBJECTS OF THE INVENTION

It is a general object of this invention to provide means for the suppression of potentially destructive electrical arcing between electrodes of the electron gun in television cathode ray tubes.

It is another object to accomplish arc-suppression by means located within the cathode ray tube envelope, rather than in circuits external to the envelope.

It is a less general object to prevent nullification of the arc-suppression means by conductive deposits from getter fall-out.

It is yet another object to make unnecessary the manufacturing process known as high-voltage conditioning, or "spot knocking," of electron guns.

It is a more specific object of this invention to provide means for the elimination of destructive arcing and thereby bring about reduced component and manufacturing costs, and ensure longer and more reliable operation of electron guns during service life.

DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Whereas the invention can be embodied in arc-suppression means of several different types, preferred embodiments of the principles of this invention are illustrated in FIGS. 2–8.

Figure 2:
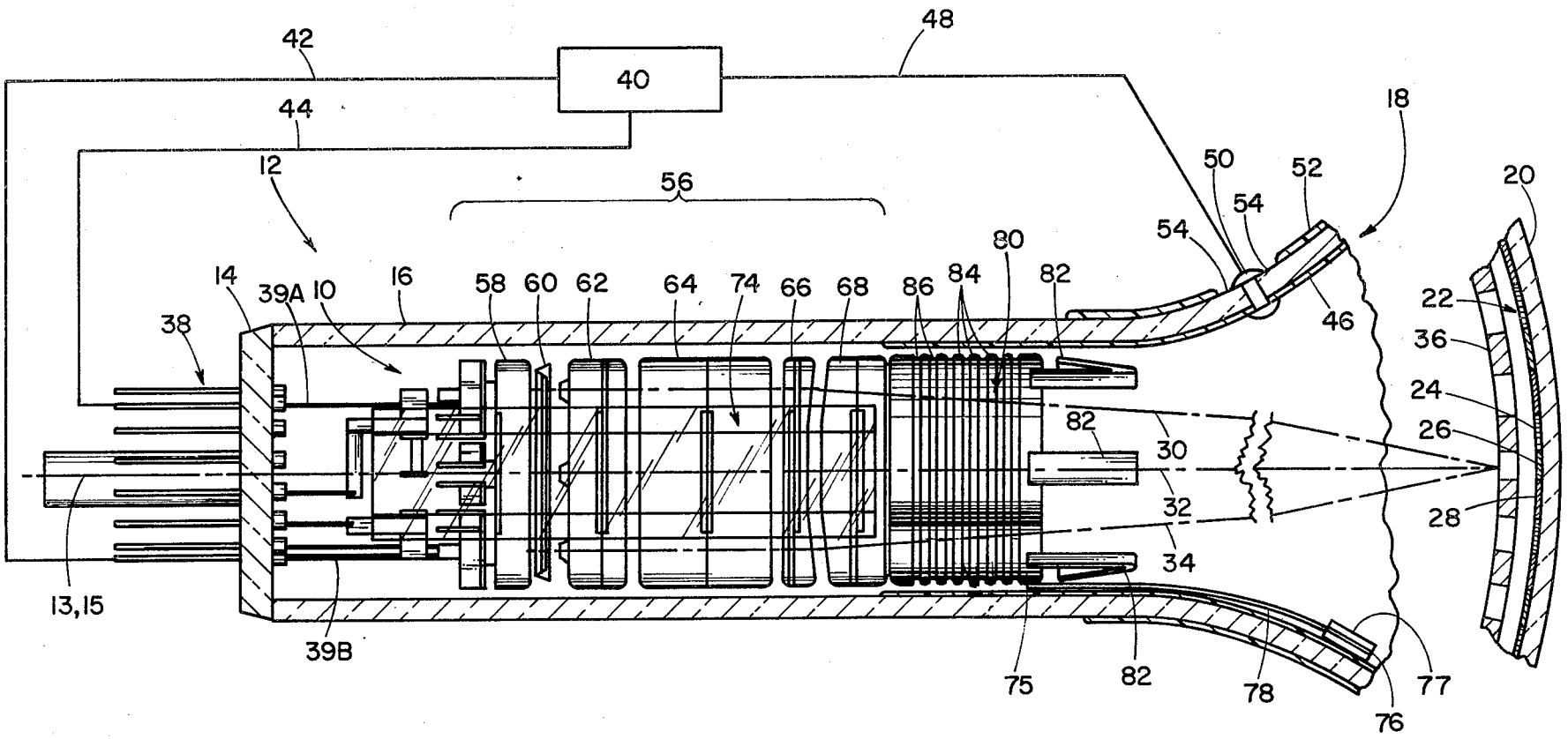
FIG. 2 is a partially sectioned fragmentary top view of a television cathode ray tube embodying an electron gun having novel arc-suppression means according to the principles of this invention.

Referring now to FIG. 2, an electron gun 10 is located within the evacuated envelope of a television cathode ray tube 12. Tube 12 is comprised of base 14, neck 16 (wherein gun 10 is located), funnel 18 and faceplate 20. On the inner surface 22 of faceplate 20 is disposed a pattern of interlaced red-emissive, green-emissive, and blue-emissive phosphor elements designated by 24, 26, and 28, respectively. The illustrated embodiment of the gun 10 is a unitized, in-line type gun that generates three co-planar electron beams 30, 32 and 34, each of which is formed, shaped and directed to selectively energize the aforesaid pattern of phosphor elements. Tube 12 has a center axis 13 with which the center axis 15 of gun 10 and its components are aligned.

Although the principles of the invention may be applied to other types of television cathode ray tubes, the illustrated tube 12 is shown as being a color television tube of the shadow-mask variety, wherein a shadow mask 36 is disposed adjacent to faceplate 20. Shadow mask 36 performs an intercessory function in relation to the three beams 30, 32 and 34 of gun 10, and the phosphor elements represented by 22, 24 and 26 deposited on the inner surface 22 of faceplate 20; that is, mask 36 serves as a parallax barrier to assure proper registration of the red-associated, green-associated and blue-associated electron beams 30, 32 and 34 with the red-emissive, green-emissive and blue-emissive phosphor elements 24, 26 and 28, respectively, located on the inner surface 22 of faceplate 20.

Base 14 provides a plurality of lead-in pins 38 for introduction into the evacuated envelope of tube 12 the television video and sync signals, as well as voltages for operation of the gun 10. A power supply 40, illustrated schematically, develops a predetermined pattern of low, medium and high voltages for application to the electrodes of gun 10 thru a plurality of electrical leads, typified by 42 and 44, which are connected to a plurality of lead-in pins 38. Low and medium voltages are conducted through lead-in pins 38 and distributed to the several electrodes of gun 10 by means of a plurality of internal electrical leads; typical leads are shown by **39*a* and 39*b*. Power supply 40 also supplies a high voltage, e.g., about 30 kilovolts, to a thin coating of electrically conductive material 46 (commonly a graphite compound) deposited on the inner surface of funnel 18 thru an electrically conductive path comprised of lead 48 and feedthrough connector 50**.

A complementary conductive coating 52 is deposited on the outer surface of funnel 18, and is electrically isolated from contact with connector 50 by space 54. Inner conductive coating 46 has a high voltage charge, while outer conductive coating 52 is at a ground potential. The two conductive coatings 46 and 52, together with the glass wall of funnel 18, a dielectric, forms a capacitor. This capacitor serves as a component of the high voltage filter circuit of power supply 40.

The electrodes 56 of gun 10 operate at various potentials ranging from relatively low to relatively high. (The principles of operation of the electron gun 10 described in general terms heretofore are described more fully and claimed in referent U.S. Pat. No. 3,995,194. ) Typical potential of the unitized, in-line gun shown by FIG. 2, and used for exemplary purposes in the description of this invention, may, for example, be as follows: unitized first grid electrode 58 for example, may be at ground potential, while the potential of the unitized second grid electrode 60 may be one kilovolt. The approximate potential on the electrodes 62, 64 and 66 may be respectively, (in kilovolts) twelve, seven, and twelve. The potential of final focus electrode 68 is nominally the same as the potential of inner conductive coating 46; that is, about thirty kilovolts. The spacing between electrodes 62, 64, 66 and 68 may be approximately forty mils. Each electrode has three apertures therethrough for the passage of beams 30, 32 and 34.

Convergence of outer beams 30 and 34 inwardly to a common point of landing with central beam 32 is accomplished by a slight angling of the two opposing planoparallel faces between electrodes 66 and 68. The angles extend outwardly and forwardly relative to the gun's central axis, as shown by FIG. 2. This convergence electrode concept does not constitute any part of this invention, but is described and claimed in the referent U.S. Pat. No. 4,058,753.

The combination of wide differences in high voltage potential of the electrodes, as described, and the close spacing therebetween, causes the electron gun to be susceptible to destructive arcing currents which may occur between electrodes. It should be noted, however, that the tendency to arc is not nearly as pronounced in the extended field lens electron gun used for descriptive purposes in this application and described in the '123 application, as it would be if it were a gun of the type such as the Einzel, or "unipotential." In the Einzel gun, the difference in electrode potentials is very great; for example, as much as 30 kilovolts between closely adjacent electrodes. The tendency to arc is obviously greater in guns of that type.

In the unitized, in-line gun described in this disclosure, electrodes 56 of gun 10 have on each side thereof at least one pair of widely spaced, relatively narrow claws embedded at widely spaced points in each of a pair of wide beads 74. (Only one bead is shown in FIG. 2.) This claw-and-bead concept does not constitute, per se, an aspect of this invention, but is described and claimed in the referent U.S. Pat. No. 4,032,811.

The present invention provides an improved arc-suppression means for electron guns. It is noted that the invention is in no way limited to the described gun, but is equally applicable to electron guns for television cathode ray tubes such as the delta-configured gun for color television, guns for beam-index television tubes, single-beam guns for monochrome television displays, and other cathode ray tube gun types plagued by arcing problems.

As described in the background section, the suppression of electrical arcing currents can be achieved by introducing a resistive impedance in the high-voltage circuit, usually between a high-voltage conductive coating located on the inner surface of the funnel and a high voltage element of the electron gun. This invention involves such an inserted impedance, but one having an improved structure.

The embodiment shown by FIG. 2 comprises a self-supporting, open-ended, electrically resistive arc-suppressing cylinder 80 which is affixed to final focus electrode 68. Alternatively, the arc-suppression means may be coupled to any high voltage element in gun 10. The cylinder 80 is coaxial with the center axis 15 of gun 10. Extending forwardly from cylinder 80 is a plurality of resilient spring means 82 which center the forward end of gun 10 in neck 16. Spring means 82, through contact with inner conductive coating 46, also conduct high voltage to cylinder 80, thus placing cylinder 80 in the electrical path between inner conductive coating 46 and final focus electrode 68 of gun 10. Alternatively, the electrical path could be completed by a flexible wire in lieu of spring means. The composition of cylinder 80 comprises an electrically resistive compound that, by its resistive properties, acts to impede or completely suppress surges of electrical current conveyed through electrical contact of gun 10 with inner conductive coating 46. Without the intercession of arc-suppression cylinder 80, and upon occurrence of an arc, a surge of current would pass through final focus electrode 68 and through the other electrodes 56 due to an arc at some point between the electrodes 56 of gun 10.

With regard to the construction of electrically resistive arc-suppression cylinder 80, in one embodiment, cylinder 80 is resistive, with concentric inner and outer surfaces, and is coated with a resistive coating on at least one of its resistive surfaces. Or, the electrical resistivity of the cylinder may comprise the entire cylinder, which may be a discrete homogeneous, self-supporting bulk resistor. In both embodiments, resilient spring means extend from the cylinders to make electrical contact with inner conductive coating 46. Electrical contact can also be made by means of a flexible wire.

It will be noted that cylinder 80 replaces the gun electrode commonly known as the "support cup" (also, "shield cup"), in that it is affixed to final focus electrode 68 in place of the support cup, and that resilient spring means 82 extend from cylinder 80. Cylinder 80 also performs another function of the support cup in that it provides for the positioning and support of getter 77. One end of a resilient spring means 78 is bonded to cylinder 80 at point 75, with the getter container, or "pan" 76, attached to the opposite end of resilient spring means 78. (This configuration is commonly known as an "antenna getter.") Resilient spring means 78 act to press getter pan 76 outwardly to make contact with an inner surface of funnel 18. Getter 77 includes a quantity of getter material, commonly an alloy of which barium is the main component. The getter 77 is caused to "flash" by raising its temperature to about nine hundred degrees centigrade by inductive heating through the glass. The getter 77, when flashed, projects getter material effective to capture residual gases in the envelope of tube 12 after evacuation of the contained air by vacuum pump means (not shown). After fall-out, some of the deposit of getter material persists in activity to capture gases released during ensuing operation.

A problem arises with regard to the fall-out of getter deposit, a problem to which this invention is addressed. The getter deposit can be electrically conductive and can create an electrically conductive shorting path which is capable of permitting an arc to bypass or substantially nullify the electrically resistive arc-suppression means heretofore described. To prevent this contingency, the arc-suppression means according to this invention includes shadowing means for shadowing at least portions of the arc-suppression means from a fall-out of getter material.

It will be seen in the embodiment of the invention shown by FIG. 2 that the surface of cylinder 80 consists of a series of axially spaced annular barriers comprised of lands 84 spaced apart by grooves 86 which provide for shadowing at least the annular portions of arc-suppression cylinder 80 from a fall-out of getter material to prevent the creation of an axially extending, electrically conductive shorting path capable of permitting an arc to bypass substantially nullify the arc-suppression characteristics of cylinder 80.

It is noteworthy that the use of the arc-suppression means described in this application makes possible the use of more efficient getters; that is, getters which project a greater quantity of active material over a larger area within the tube, thereby ensuring a higher vacuum. But it is also worthy of note that the more efficient the getter, the greater will be the fall-out of getter material within the tube; hence the need for the effective shielding of the arc-suppression means of this invention.

Figure 1:
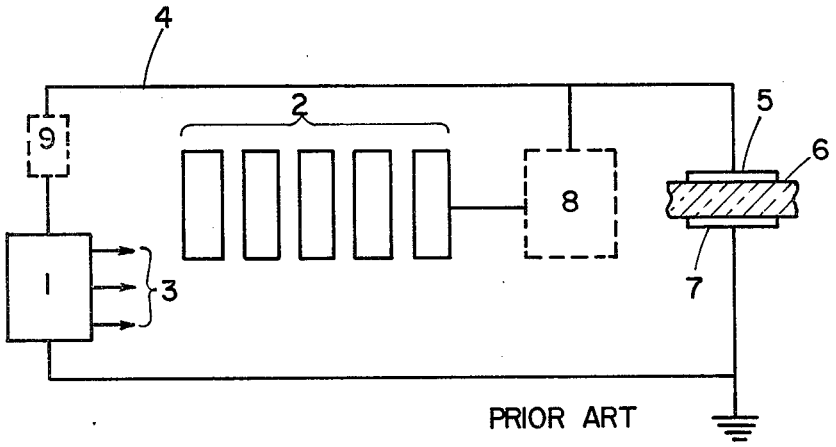
FIG. 1 is a simplified schematic diagram of prior art means for arc-suppression in television systems.
Figure 3:
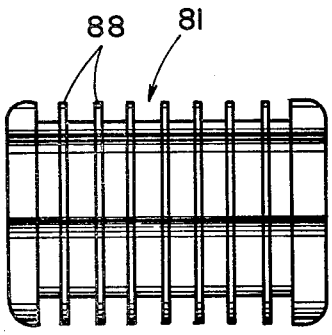
FIGS. 3, 4 and 5 show details of the various configurations of shadowing means according to this invention.
Figure 4:
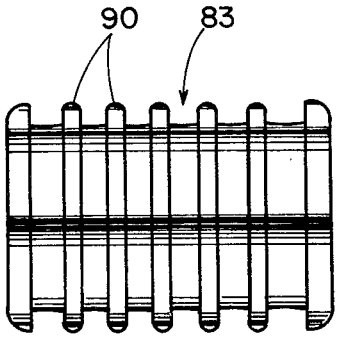
Figure 5:
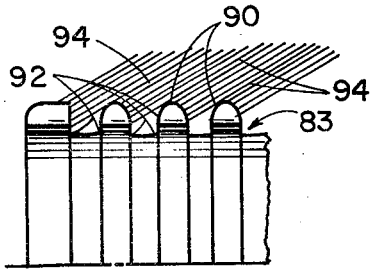

The axially spaced annular barriers may comprise many forms other than the lands 84 depicted on cylinder 80 in FIG. 2. To cite examples: the barriers may comprise a series of rings 88 on the surface of cylinder 81, as shown by FIG. 3. Or, as shown by FIG. 4, the axially spaced, annular barriers may comprise a series of ridges 90 on cylinder 83. FIG. 5 shows in detail the shadowing by ridges 90 of substantial portions 92 of the surface of cylinder 83 from a fall-out of getter material 94.

Figure 6:
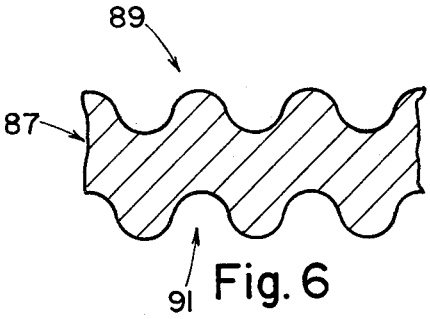
FIG. 6 is a view in section of another embodiment wherein a bulk resistor in serpentine form comprises the arc-suppression means.
Figure 6A:
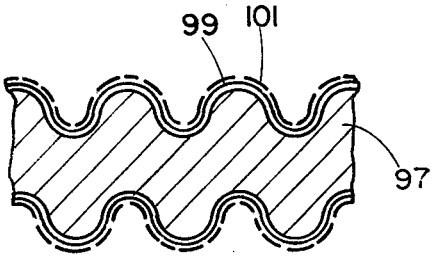
FIG. 6A is a view in section of an arc-suppression means in the form of an insulative substrate in serpentine form coated with a resistive material and an insulative jacket.

FIG. 6 shows an embodiment wherein an outer surface 89 and an inner surface 91 of an arc-suppression cylinder 87 is comprised of cooperating lands and grooves to provide a serpentine cross-section. In addition to shading at least portions of surfaces 89 and 91 from a fall-out of getter material, the serpentine configuration also serves to increase the resistive length of arc-suppression cylinder 87. The embodiment shown by FIG. 6 is that of a homogeneous, self-supporting bulk resistor; however, the increase in path length supplied by the land-and-groove configuration also applies when the arc-suppression means comprises an insulative substrate 97 (referring to FIG. 6A) having a resistive coating 99 deposited thereon to provide an increase in the length of the resistive path of resistive coating 99 as well as shadowing the surface.

The shadowing means described heretofore provides for shadowing at least portions of the exposed resistive surface of the resistive element from getter deposits. As a consequence, the resistive element is only partially bypassed, and the arc-suppression means continues to provide a measure of arc-suppression. However, to prevent nullification of any portion of the total resistance value, an insulative coating 101 may be applied to resistive surface 99. This insulator could also be in the form of a sleeve, or jacket. By this means, the maximum value of resistance is provided up to the point where the amount of getter deposit is so great that arc-over may occur across the insulator, whereby the resistive element is completely nullified.

Figure 7:
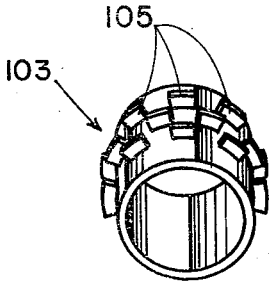
FIG. 7 is an end view in perspective of still another embodiment of shadow means according to this invention.

FIG. 7 shows another embodiment of the invention wherein an arc-suppression means 103, here shown as a cylinder, is provided with annular barriers 105 that are discontinuous, and form a series of projecting shields around the arc-suppression means, and wherein axially adjacent ones of the annular barriers are similarly discontinuous but slightly rotated circumferentially to form a series of angularly staggered, axially spaced, radially extending shields for shadowing the surface of arc-suppression means 103.

With regard to the properties of the resistive coating used to coat a self-supporting insulative cylinder, for example, the resistive material of arc-suppression cylinder 80 shown in FIG. 2 may, for example, be made from a coating of tin oxide frit suspended in a frit vehicle and subsequently baked at 450° C. in air prior to installation in tube. Or, the coating may be one of a group of organo-metallic compounds known as resinates, or "lusters." Good results have been obtained with an iridium and tungsten mixture. Depending upon the type of resistive coating, and the amount of resistance desired, the thickness of the coating may range from very thin (a few microns in the case of resinates) to one of four mils or more in the case of frits. The coatings may be applied by brushing on the cylinder, for example, or the cylinder may be dip-coated and then fired at an elevated temperature in air. Stable resistance in the range of two kilohms/cm$^2$ to ten megohms/cm$^2$ have been obtained.

Prior to applying the resistive coating, the axially spaced, annular barriers 84 (referring to FIG. 2) may be molded into the cylinder 80, or the barriers may be machined into the surface of the cylinder by appropriate cutting tools. The barriers with resistive coating installed could also be embodied in a sleeve press-fitted onto the cylinder.

With regard to the value of the resistance provided by the arc-suppression means for the suppression of arcs, the resistive impedance must be of such value as to maintain the high voltage element of gun 10 to which the arc-suppression means is attached at substantially the same potential as the inner conductive coating 46 when coating 46 is high-voltage-charged. At the same time, the arc-suppression resistive means must provide an electrically conductive path of such resistive value as to adequately suppress any arcing which may take place in gun 10. Resistive impedances from a few kilohms to as high as ten megohms have been found efficacious in suppressing arcs in the embodiments of the invention set forth in this disclosure. The preferred range is from one kilohm to ten megohns.

Another method of depositing the resistive coating, while at the same time applying the annular barriers, may be by the process of spraying of the coating while masking the grooves to create alternate lands and grooves. The resistive coating, with appropriate annular barriers, can be deposited on the inside of cylinder 80 or in the preferred embodiment, on both inside and outside surfaces.

The cylindrical form on which the resistive coatings are deposited may be a nonconductor such as glass. An example of such a form is a machineable glass known as Macor (registered trademark of Corning Glass Works). Or the form can be made of a machineable ceramic.

For exemplary purposes, and not in a limiting sense, the approximate dimensions of cylinder 80, as shown by FIG. 2, are set forth as follows. Length of cylinder 1.0 inch; outside diameter, 0.80 inch; and inside diameter, 0.70 inch. The distance from the top of a land 84 to the bottom of an adjacent groove 86 is 0.03 inch.

Effective shadowing can be achieved using shadowing means on a much smaller scale than that described heretofore. Rather than distinct annular lands and grooves, the shadowing means may comprise a sandblasted surface to which is applied a resistive coating of resinate only a few microns thick. The surface irregularities are large in magnitude in comparison to the very thin resistive deposit. In this aspect of the preferred embodiment, effective shadowing is provided even though the resistive surface may appear relatively smooth to the naked eye.

Alternatively, in another aspect of the preferred embodiment, the entire structure of arc-suppression cylinder 80 may comprise a self-supportive homogeneous, open-ended, electrically transmissive bulk resistive material having shadowing means molded or machined into the surface. An example of a suitable bulk resistive material is that supplied by 3M Corporation under the trademark "Alchromia."

In another embodiment of this invention (referring now to FIG. 8), the arc-suppression means may comprise a resistive coating 96 deposited on an inner surface 99 of neck 98 of cathode ray tube 100. In this embodiment, the axially spaced annular barriers comprise lands 104 separated by grooves 106. Resistive coating 96 is in electrical contact with the inner conductive coating 108 at contact line 109. Inner conductive coating 108 in turn is supplied with high voltage by feed-through conductor 110 connected to a power supply 112 through lead 114. Support cup 118, to which final focus electrode 116 is electrically and mechanically affixed, has extended rearwardly from its structure resilient spring means 120 which are bonded, as by welding, to support cup 118. Thus the electrically conductive path between power supply 112 and final focus electrode 116 is completed. The electrically conductive path could as well be completed by a flexible wire if lieu of the spring means cited, and connected to any high voltage element.

In this configuration of the preferred embodiment, support cup 118 is shown as a shallow cup from which resilient spring means 120 extend backwardly and outwardly. In the subject configuration, the relative shallowness of support cup 118 and the backward-extension of spring means 120 provide for greater path length of resistive coating 96. If a shorter resistive path length is deemed adequate, the length of the support cup can be extended and the resilient spring means 120 can be extended forwardly.

Figure 8:
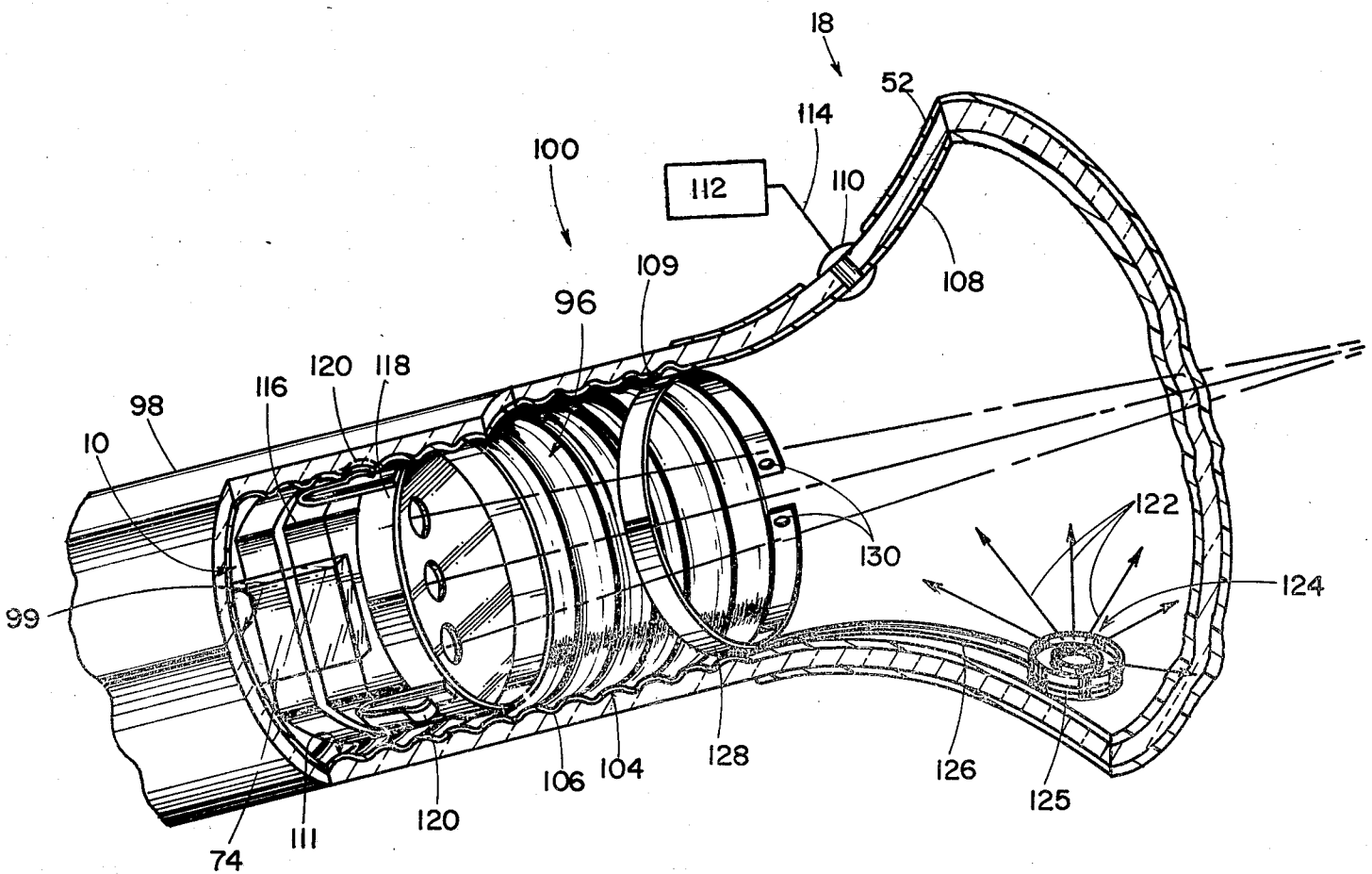
FIG. 8 is a view partially in section and in perspective showing yet another embodiment of arc-suppressing means according to this invention.

The axially spaced annular barriers shown in FIG. 8 comprise alternate lands 104 separated by grooves 106. Alternatively, and in the spirit of this invention, the barriers could comprise a series of rings 88 similar to those shown by FIG. 3, or, a series of ridges 90 similar to those shown by FIG. 4.

Whatever their configuration, the annular barriers may be formed integrally on the inner surface 99 of neck 98 during the neck molding process of cathode ray tube 100. Or, the barriers may as well be formed, for example, by grinding or etching means. Following the formation of the annular barriers, the resistive coating means is preferably applied.

The composition of resistive coating 96 can be as described heretofore for coating arc-suppression cylinder 80 shown in FIG. 2; that is, a tin oxide frit or a resinate having coating thicknesses as described. Similarly, the coating may be applied by spraying, brushing on, or washing on, after which the coating is fired in air. Other means of coating may be used provided that an homogeneous layer is applied. Usually, resistive coating 96 would be applied following the formation of the annular barriers.

Whereas the embodiments of the arc-suppression means described in the foregoing have been depicted as being cylindrical, the invention is nowise so limited. Arc-suppression means having other shapes such as sections of cylinders, rectangular cross-sections, resistive bars, or resistive strips may be utilized provided the shadowing means according to this invention are therein embodied to prevent the bypassing or substantial nullification of the resistive value of the arc-suppression means employed.

The function of the axially spaced, annular barriers is to provide shadowing means for shadowing at least portions of the resistive coating 96 such as to prevent the deposit of the getter 124 on an axially continuous, electrically conductive shorting path from one end to the other of resistive coating 96. The fall-out paths of getter 124 are indicated by lines 122 of FIG. 7.

The pan of a getter is commonly attached to the gun support cup by resilient spring means (Cf. FIG. 2 and method of getter attachment by resilient spring means 126). In the subject configuration, however, wherein the arc-suppression resistive coating 96 comprises a layer on the inner surface 99 of neck 98, such an attachment method would not be feasible because the required arc-suppression means; that is, resistive coating 96 would obviously be electrically bypassed by the direct attachment of a resilient spring means to support cup 118.

In accordance with an aspect of this invention, a practical alternative means of getter support is provided by the use of an expansive split spring collar 128 to which resilient spring means 126 is bonded. Collar 128 comprises spring means having a circumference greater than the circumference of the inner surface 99 of the neck 98. As a result, when installed, collar 128 exerts an outward, self-retaining pressure on the inner surface 99 or neck 98 adjacent to the junction of the neck 98 and funnel 18. The installation of collar 128 during manufacture is facilitated by utilizing the tab means 130 extending from collar 128 for gripping and retracting the collar.

Other changes may be made in the above-described apparatus without departing from the true spirit and scope of the invention herein involved, and it is intended that the subject matter in the above depiction shall be interpreted as illustrative and not in a limiting sense.

What is claimed is:

1. In a television cathode ray tube comprising an evacuated envelope including a faceplate and a funnel having on an internal surface an inner conductive coating for receiving a high-voltage charge, said tube further comprising an electron gun located in a neck of the funnel for producing at least one beam of electrons, and getter means within said envelope for projecting, when flashed, getter material effective to capture residual gases in said evacuated envelope in said tube, the improvement comprising an electrically resistive arc-suppression means electrically connected in an electrical path between said inner conductive coating and a high voltage element of said gun, said arc-suppression means having a surface physically exposed to a deposit of said getter material when said getter is flashed, said arc-suppression means including shadowing means distributed across said surface for shadowing at least portions of said exposed surface from a deposit of said getter material to prevent the creation of an electrically conductive shorting path capable of permitting an arc to bypass or substantially nullify said arc-suppression means.

2. The combination defined by claim 1 wherein said arc-suppression means is comprised of a self-supporting cylinder in axial alignment with said high voltage element and affixed thereto, and wherein said cylinder is electrically connected to said inner conductive coating to complete said electrical path.

3. The combination defined by claim 2 wherein said shadowing means is comprised of axially spaced annular barriers on said arc-suppression means.

4. The combination defined by claim 3 wherein said annular barriers on said arc-suppression means are comprised of alternate lands and grooves in said surface.

5. The combination defined by claim 3 wherein said annular barriers serve to increase the resistive length of said arc-suppression means as well as to shadow said surface.

6. The combination defined by claim 3 wherein said annular barriers serve to interrupt an arc path on said cylinder.

7. The combination defined by claim 2 wherein said cylinder is insulative with concentric inner and outer surfaces and is coated with a resistive coating on at least one of its concentric surfaces.

8. The combination defined by claim 2 wherein said cylinder comprises a discrete, homogeneous, self-supporting bulk resistor.

9. The combination defined by claim 3 wherein said annular barriers are located on an inner surface and an outer surface of said arc-suppression means.

10. The combination defined by claim 3 wherein at least one of said annular barriers on said arc-suppression means is discontinuous and forms a series of projecting shields around said arc-suppression means, and wherein axially adjacent ones of said annular barriers are similarly discontinuous but slightly rotated circumferentially to form on said surface of said arc-suppression means a series of angularly staggered, axially spaced, radially extending shields.

11. The combination defined by claim 1 wherein said arc-suppression means comprises a resistive coating deposited on an inner surface of said neck of said tube and in electrical contact with said inner conductive coating wherein said resistive coating is electrically connected to said high voltage element to complete an electrically conductive path and wherein said shadowing means is comprised of axially spaced, annular lands and grooves formed in said inner surface of said neck, said lands and grooves serving to increase the resistive length of said resistive coating as well as to shadow annular portions of said resistive coating from projected getter material.

12. For use in a television cathode ray tube, an improved arc-suppression electron gun having a series of electron-beam forming and focusing electrodes and getter means for projecting, when flashed, getter material effective to capture residual gases in said evacuated envelope in said tube, said gun comprising a self-supporting electrically resistive, open-ended, arc-suppression cylinder coaxial with said gun and affixed to a high voltage element in said gun, said cylinder having a surface which is physically exposed to a deposit of said getter material when the gun is mounted in the tube and said getter is flashed, said cylinder further including shadowing means distributed across said surface for shadowing at least portions of said exposed surface from deposits of getter material to prevent the creation of an axially extending, electrically conductive shorting path capable of permitting an arc to bypass or substantially nullify said arc-suppressing cylinder.

13. The combination defined by claim 12 wherein said shadowing means is comprised of axially spaced annular barriers on said cylinder, and wherein said barriers comprise alternate lands and grooves in said surface.

14. The combination defined by claim 12 wherein said cylinder is insulative with concentric inner and outer surfaces and is coated with a resistive coating on at least one of its concentric surfaces.

15. The combination defined by claim 12 wherein said cylinder comprises a discrete, homogeneous, self-supporting bulk resistor.

16. The combination defined by claim 13 wherein at least one of said annular barriers on said cylinder is discontinuous and forms a periodic series of projecting shields around said arc-suppression means, and wherein axially adjacent ones of said annular barriers are similarly discontinuous but slightly rotated circumferentially to form on said surface of said cylinder a series of angularly staggered, axially spaced, radially extending shields.

17. An improved arc-suppressing television cathode ray tube comprising an evacuated envelope including a faceplate and funnel having on an internal surface an inner conductive coating for receiving a high voltage charge, said tube further comprising an electron gun located in a neck of the funnel and having a series of electron-beam forming and focusing electrodes including a high voltage element, and getter means within said envelope for projecting, when flashed, getter material effective to capture residual gases in said evacuated envelope in said tube, the improvement comprising an open-ended, electrically resistive arc-suppression means embodied in an internal surface of said neck and in electrical contact with said inner conductive coating, with said arc-suppression means being coaxial with said gun and electrically connected in an electrical path between said inner conductive coating and said high voltage element, and having a surface physically exposed to the deposit of said getter material when said getter is flashed, said arc-suppression means including axially spaced, alternating lands and grooves distributed across said surface for shadowing at least portions of said exposed surface from a deposit of said getter material to prevent the creation of an electrically conductive shorting path capable of permitting an arc to bypass or substantially nullify said arc-suppression means, and wherein said alternating lands and grooves increase the resistive length of said electrically resistive arc-suppression means.

* * * * *